US006123228A

United States Patent [19]

Hippensteel

[11] Patent Number: 6,123,228

[45] Date of Patent: Sep. 26, 2000

[54] SELF-DEFENSE RING APPARATUS

[76] Inventor: Joseph B. Hippensteel, 1596 Belle Isle Cir., NE., Atlanta, Ga. 30305

[21] Appl. No.: 09/327,763

[22] Filed: Jun. 7, 1999

Related U.S. Application Data

[63] Continuation-in-part of application No. 09/094,155, Jun. 9, 1998.

[51] Int. Cl.[7] ..... B67D 17/04

[52] U.S. Cl. ..... 222/78; 222/175; 222/192; 222/153.11; 222/325; 222/402.11

[58] Field of Search ..... 222/3, 102.11, 222/153.11, 78, 175, 183, 192, 325, 402.1, 402.11, 402.15, 402.24

[56] References Cited

U.S. PATENT DOCUMENTS

| | | | |
|---|---|---|---|
| 3,353,749 | 11/1967 | Lahaug . | |
| 3,837,537 | 9/1974 | Baldwin | 222/153.11 |
| 3,987,939 | 10/1976 | Pedone, Jr. et al. | 222/325 |
| 4,058,237 | 11/1977 | Luke . | |
| 4,061,249 | 12/1977 | Smith . | |
| 4,135,645 | 1/1979 | Kimmell . | |
| 4,241,850 | 12/1980 | Speer . | |
| 4,308,976 | 1/1982 | Speer et al. . | |
| 4,431,118 | 2/1984 | Mamdari . | |
| 4,550,861 | 11/1985 | Fay, Sr. et al. . | |
| 5,011,044 | 4/1991 | Brown . | |
| 5,088,624 | 2/1992 | Hackett et al. . | |
| 5,104,003 | 2/1994 | Stecoza | 222/325 |
| 5,217,143 | 6/1993 | Aitken . | |
| 5,282,551 | 2/1994 | Pierson | 222/153.11 |
| 5,316,182 | 5/1994 | Lee et al. . | |
| 5,358,144 | 10/1994 | Mock . | |
| 5,509,581 | 4/1996 | Parsons | 222/325 |
| 5,678,730 | 10/1997 | Fabek et al. . | |

OTHER PUBLICATIONS

Product Brochure for PUNCH!, Aerko International, 3410 N.E. 5th Avenue, Ft. Lauderdale, FA 33334 (no date).

*Primary Examiner*—Kevin Shaver
*Assistant Examiner*—Thach Bui
*Attorney, Agent, or Firm*—Morris, Manning & Martin, LLP

[57] ABSTRACT

The apparatus of the invention can be used to deter attack by an assailant such as a person or animal. The apparatus includes a ring defining a cavity and a spray orifice communicating with the cavity. The apparatus also includes a canister removably fitted to the ring in the cavity, and a repellent substance contained in the canister under relatively high pressure relative to ambient. The canister defines a spray orifice, and has a valve stem movable to discharge the pressurized repellent substance from the canister and ring through respective aligned spray orifices defined therein. The apparatus also includes a safety movably mounted to the ring. The safety can be moved to a first position that blocks the valve stem to prevent movement of the valve stem so that accidental discharge of pressurized repellent substance from the canister is prevented. The safety also has a second position that frees the valve stem so that a user can depress the valve stem to discharge the repellent substance through the spray orifices of the canister and ring at an assailant. The safety can include ridges to provide a finger hold to move the safety. The apparatus can include a wedge that secures the canister in the ring so that the spray orifices of the ring and canister are aligned.

17 Claims, 6 Drawing Sheets

Fig 7a
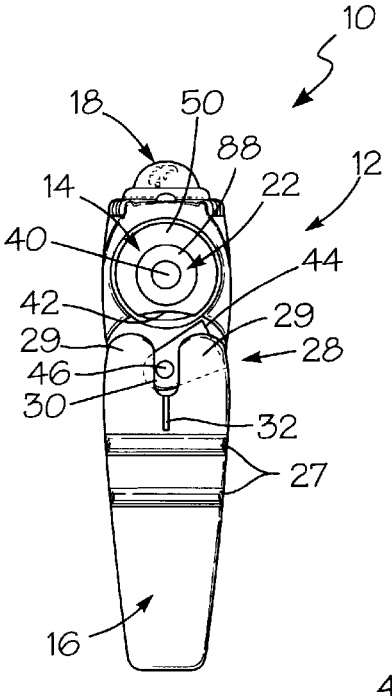
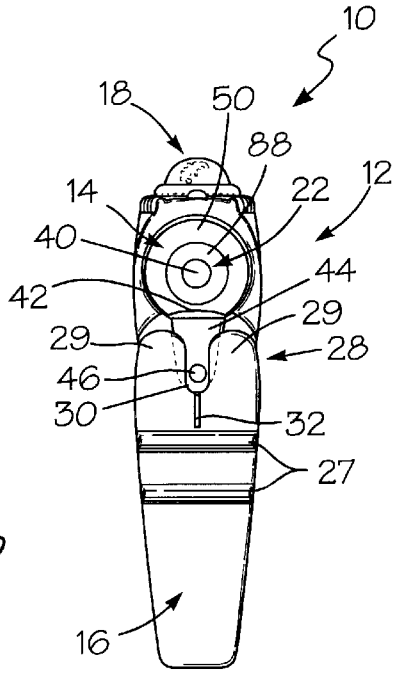
Fig 7b
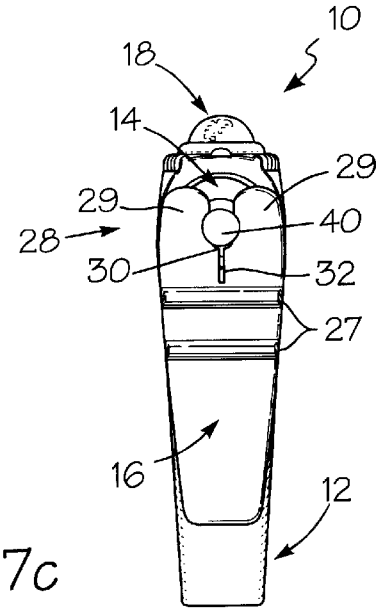
Fig 7c

SELF-DEFENSE RING APPARATUS

CROSS-REFERENCE TO RELATED APPLICATION

This application is a continuation-in-part of application Ser. No. 09/094,155 filed Jun. 9, 1998 entitled "Anti-Assault Apparatus" naming Joseph B. Hippensteel as the sole inventor.

FIELD OF THE INVENTION

1. Background of the Invention

The invented apparatus is directed to a ring that contains a repellent that can be used by the ring wearer to deter an assault by an assailant such as a person or animal.

2. Description of the Related Art

Attack deterrent devices of the type that emit a repellent spray have been disclosed for use in personal protection. U.S. Pat. No. 5,088,624 (hereinafter referred to as "the '624 patent") issued Feb. 18, 1992 to Hugh Hackett et al. is an example of such a device. The device includes a housing that contains one or more canisters containing a noxious chemical, an irritant such as mace and/or an indelible dye for later identification of an assailant. Although the canisters afford great flexibility in the type of anti-assault spray that can be used, the housing of the '624 patent's device is relatively large, on the order of seven centimeters or more, and the device is therefore relatively unwieldy to carry on one's person. In addition, because it is rather large and unusual in appearance, the device of the '624 patent can be spotted and possibly disarmed by an assailant before the victim carrying the device has the opportunity to use such device to ward off an attack. It would be desirable to overcome these disadvantages of the prior art.

Finger rings which contain a repellent that can be discharged at an attacker have also been known for use in the field of personal protection. For example, U.S. Pat. No. 3,353,749 (hereinafter referred to as "the '749 patent") issued Oct. 22, 1965 to H. A. Lahaug, U.S. Pat. No. 4,061,249 (hereinafter referred to as "the '249 patent") issued Dec. 6, 1977 to Dale Maxwell Smith, and U.S. Pat. No. 4,135,645 (hereinafter referred to as "the '645 patent") issued Jan. 23, 1979 to Steven D. Kimmell, all disclose rings which contain repellent sprays for discharge at an attacker. These rings are generally advantageous in that they conceal from an assailant the fact that the ring wearer is armed with repellent. Accordingly, the assailant will not know in advance of attacking that the ring wearer is armed with repellent, and will thus not be able to disarm the ring wearer before the ring wearer has the opportunity to disable the attacker with repellent spray. However, the devices of the '749, '249 and '645 patents all suffer from the disadvantage that their repellent supplies cannot be readily replaced after they are discharged. In addition, with the device of the '645 patent, the user has but one opportunity to disable an attacker because the entire repellent supply is consumed when triggered. Furthermore, the '749 and '249 patents have no safety device to prevent accidental discharge of the repellent, and the safety device of the '645 patent is positioned under the ring where such safety device is difficult to manipulate to allow triggering to discharge the repellent contents at an attacker. It would be desirable to overcome these disadvantages of previous self-defense ring devices.

SUMMARY OF THE INVENTION

It is an object of the present invention to provide a self-defense ring with a canister that can be readily replaced after discharge of repellent contained therein.

It is another object of the present invention to provide a self-defense ring that is substantially normal in appearance so that its self-defense capability will not be recognized by an assailant.

It is a further object of the invention to provide a self-defense ring that affords several opportunities to disable an attacker with sprayed repellent.

It is yet another object of the invention to provide a self-defense ring with a safety that can be readily manipulated by a user to arm the self-defense ring to discharge repellent spray, but which can also be manipulated into a position in which accidental discharge of repellent from the ring is virtually impossible.

It is an additional object of the invention to provide a self-defense ring in which alignment between sprays orifices of the ring and a canister containing repellent positioned in the ring, can be readily assured for proper discharge of repellent spray.

The apparatus of the present invention overcomes the above-stated disadvantages of previous self-defense devices, and attains the above-stated objects and advantages. The apparatus of the present invention includes a ring defining a cavity and a spray orifice communicating with the cavity. The apparatus also includes a canister removably fitted to the ring in the cavity, and a repellent substance contained in the canister under a pressure greater than ambient pressure. The canister defines a spray orifice, and has a valve stem movable to discharge the pressurized repellent substance through the spray orifices of the canister and ring. The apparatus further includes a safety movably mounted to the ring. The safety can be moved to a first position that blocks the valve stem to prevent its movement, to avoid accidental discharge of the pressurized repellent substance from the canister. The valve stem also has a second position that unblocks the valve stem to permit the valve stem to be moved by the ring wearer to discharge the repellent substance through the spray orifices of the canister and ring at an assailant.

These together with other objects, features and advantages, which will become subsequently apparent, reside in the details of construction and operation of the apparatus as more fully hereinafter described and claimed, reference being made to the accompanying drawings, forming a part hereof wherein like numerals refer to like parts throughout the several views.

BRIEF DESCRIPTION OF THE DRAWINGS

FIGS. 7*a*–7*c* are side elevation views of a sequence of steps for loading the canister in the ring;

DESCRIPTION OF THE PREFERRED EMBODIMENTS

Figure 1:
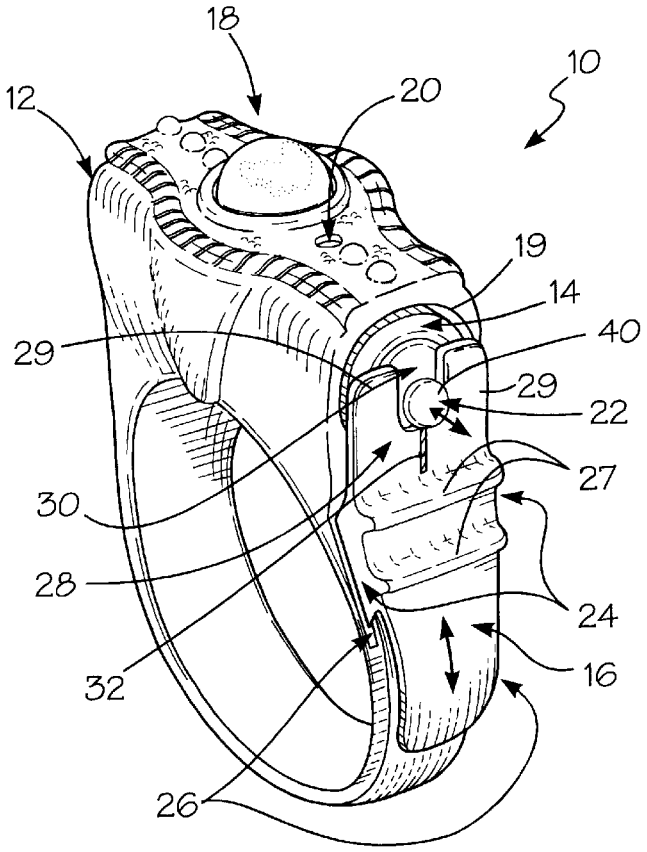
FIG. 1 is a perspective view of the self-defense ring apparatus of the present invention.

In FIG. 1, a self-defense ring apparatus 10 of this invention is shown. The apparatus 10 includes a ring 12, a canister 14, and a safety 16. The ring 12 can have ornamental features 18 such as relief patterns and jewel stones, to disguise the self-defense capability of the apparatus 10 as well as to provide an attractive appearance. The ring 12 also defines a cavity 19 shaped to receive the canister 14. In addition, the ring 12 includes a spray orifice 20 that communicates with the cavity 19 defined in the ring 12. The canister 14 can be configured in a cylindrical shape, for example, and defines a hollow interior to contain a pressurized repellent substance. The canister 14 includes a valve stem 22 that can be used to discharge pressurized repellent substance from the hollow interior of the canister if the safety 16 is disengaged from the valve stem. The safety 16 includes opposing clasps 24 that engage with respective grooves 26 defined in the ring 12. The clasps 24 secure the safety 16 to the ring 12. The clasps 24 are also capable of sliding in respective grooves 26 of the ring 12 to allow the safety 16 to be moved to a position engaged with the valve stem 22, as shown in FIG. 1, to block movement of the valve stem. The clasps 24 are also slidable in the grooves 26 defined in the ring 12 to permit the safety to be moved along the side of the ring to a position disengaged from the valve stem. If the safety 16 is disengaged from the valve stem 22, the ring user can move the valve stem in a direction into the canister to discharge pressurized repellent substance from the canister and ring. The safety 16 can also define ridges 27 which permit a user of the apparatus 10 to grip the safety 16 with a thumb or finger tip to slide the safety between positions engaged and disengaged with the valve stem 22. The safety 16 can further include a forked end 28 that includes two opposing tines 29 spaced by a groove 30. The tines 29 of the forked end 28 can be engaged with and grip opposite sides of the valve stem 22 to prevent the valve stem from moving. The forked end 28 of the valve stem 22 can also define a slit 32 communicating with the groove 30, that allows the tines 29 of the safety's forked end 28 to be spread and to grip the valve stem 22 if they are forced into contact with the valve stem, as shown in FIG. 1.

Figure 2:
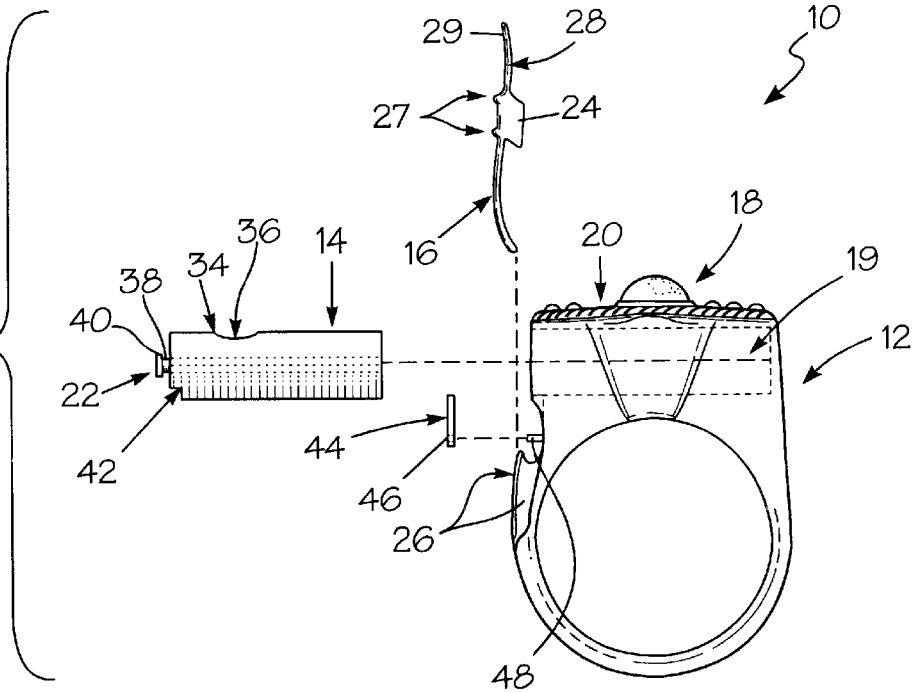
FIG. 2 is an exploded view of the self-defense ring apparatus.

In FIG. 2, the canister 14 is shown extracted from the cavity 19. The cavity 19 is indicated in broken line to represent that the cavity is inside of the ring 12 and thus would not be visible to the eye in FIG. 2. The canister 14 includes a flat area 34 about its spray orifice 36 (not visible in FIG. 2) that permits a fill nozzle (not shown in FIG. 2) to be moved into pressure-tight contact with the canister. The nozzle can be used to fill or refill the hollow interior of the canister 14 with pressurized repellent. FIG. 2 also shows that the valve stem 22 includes a relatively thin portion 38 and a relatively wide portion 40 at the end of the valve stem. The forked end 28 of the safety 16 can be moved to a position to engage the relatively thin portion 38 of the valve stem 22. In this position, the safety 16 blocks the relatively thick portion 40 so that the valve stem cannot be moved, to prevent accidental discharge of repellent from the canister. The canister 14 also defines a notch or detente area 42. The apparatus 10 can also include a wedge 44 that has a bore 46 (not visible in FIG. 2) defined therein. The ring 12 can include a pin 48 extending from its side in proximity to the opening of the cavity 19 defined in the ring. The wedge 44 can be slid onto the pin 48 via the bore 46. The end of the pin 48 can be tapped with a hammer, for example, to flatten the end of the pin to secure the wedge 44 thereon. As so mounted, the wedge 44 is free to pivot about the pin 48.

More specifically, the wedge 44 can be pivoted about the pin 48 so that the wedge is clear of the opening of the cavity 19 defined in the ring 12. In this position of the wedge, the canister 14 can be removed from or inserted into the ring 12. To secure the canister 14 inside the cavity 19 defined in the ring 12, the wedge 44 can be pivoted about the pin 48 so that it engages with the notch 42 defined in the canister 14. The notch 42 is defined in the end of the canister 14 in relation to the canister's spray orifice 36 and the wedge 44 is positioned relative to the ring's spray orifice 20 so that the canister's spray orifice is aligned with the ring's spray orifice if the wedge 44 can be pivoted into contact with the notch 42. Conversely, the canister's spray orifice 36 is not properly aligned with the ring's spray orifice 20 if the wedge 44 cannot be moved into the notch 42 defined in the canister 14 but is instead blocked by the side end of the canister. The wedge 44, pin 48 and notch 42 defined in the canister 14 can therefore be used to ensure that the ring and canister orifices 20, 36 are aligned. Such alignment of the ring and canister orifices 20, 36 ensures that a burst of repellent spray discharged from the canister 14 by depressing the valve stem 22 will be relatively direct and dense, and travel over a significant distance to disable an assailant.

Figure 3A:
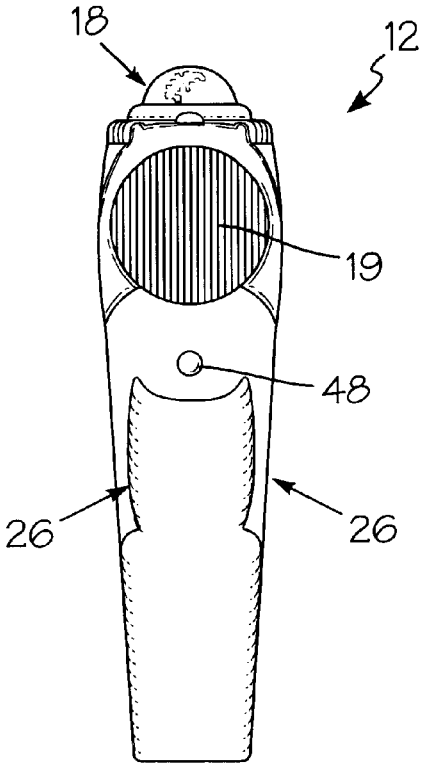
FIG. 3*a* is a side elevation view of the ring.
Figure 3B:
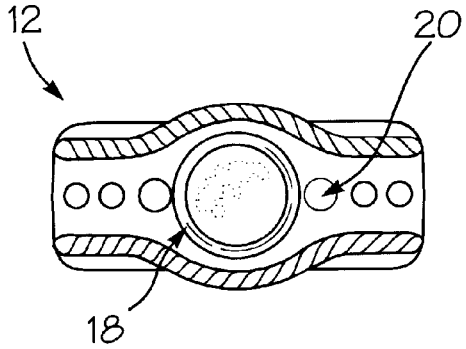
FIG. 3*b* is a top plan view of the ring.
Figure 4:
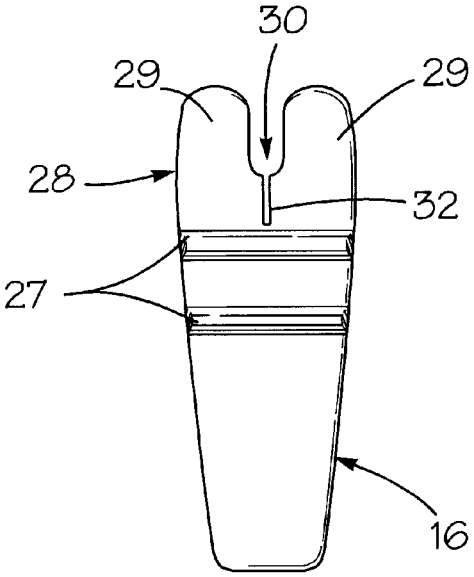
FIG. 4 is a side elevation view of a safety of the apparatus.
Figure 5:
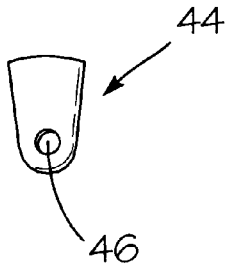
FIG. 5 is a side elevation view of a wedge of the apparatus.

FIG. 3*a* shows the ring 12 with the safety 16 and the wedge 44 removed therefrom. In FIG. 3*a*, the ornamental features 18, cavity 19, grooves 26 positioned on opposite sides of the ring 12, and the pin 48, are visible. FIG. 3*b* shows the ring 12 with the safety 16 and the wedge 44 removed therefrom. The ornamental features 18 and the spray orifice 20 defined in the ring 12 can be readily seen. FIG. 4 shows the safety 16 including forked end 28 with opposing tines 29 and groove 30 defined therebetween. Slit 32 communicating with groove 30 is also readily seen in FIG. 4, in addition to the ridges 27 extending outwardly relative to the main surface of the safety 16. FIG. 5 shows the wedge 44 and the bore 46 defined therein. As shown in FIG. 5, the wedge 44 can be shaped in an approximately triangular configuration with a flat or a slightly rounded end for engagement with the notch 42 defined in the canister 14.

Figure 6A:
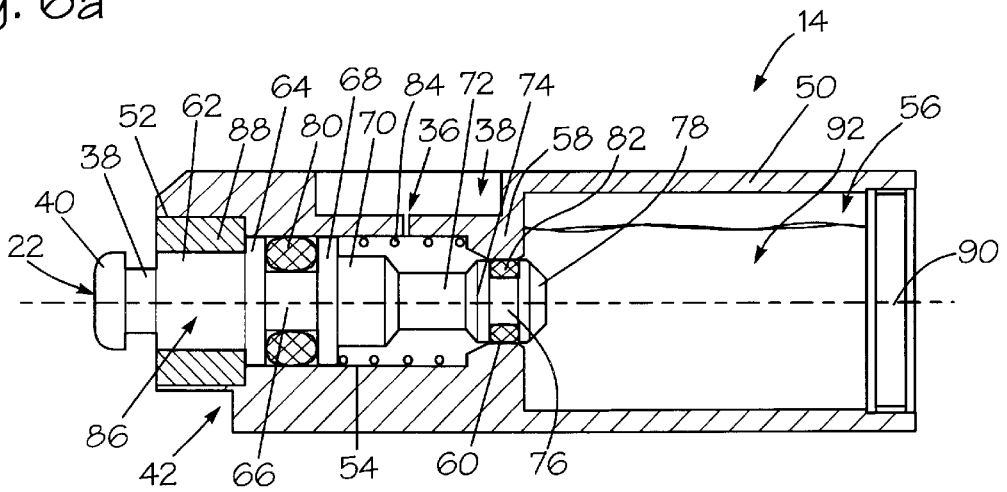
FIG. 6*a* is a partial cross-sectional view of the canister of the apparatus with its valve stem in a first extended position blocking discharge of pressurized repellent from the canister.

In FIG. 6*a*, the canister 14 is shown in partial cross-section. The canister 14 includes an approximately cylindrical member 50 that defines an annular recess 52, a cavity 54 communicating with the recess 52 if the valve stem 22 is removed from the member 50, and a repellent reservoir 56 communicating with the cavity 54 if the valve 22 is removed from the member 50. The cavity 54 and the reservoir 56 are separated by inner wall 58 formed integrally with the member 50. The inner wall 58 defines a bore 60 that permits communication between the cavity 54 and the reservoir 56 defined by the member 50 if the valve stem 22 is positioned to so allow. The cavity 54 also communicates with the spray orifice 36 defined in the member 50. The valve stem 22 has cylindrical portions of various thickness defined from one end to the other end thereof. More specifically, from the left to right side of FIG. 6*a*, the valve stem 22 includes the relatively wide portion 40, the relatively thin portion 38, a washer-engaging portion 62, a flange 64, an o-ring engaging portion 66, and a flange 68. The valve stem 22 also has a spring-retaining portion 70, a relatively thin passage portion 72, a flange 74, an o-ring engaging portion 76, and a flange 78. The canister 14 also includes o-rings 80, 82 and a resilient member 84 such as a spring. The resilient member 84 compresses under a force of about thirty (30) Newtons (i.e., seven pounds). Before assembly of the canister 14, the valve stem 22, o-rings 80, 82, spring 84 and member 50 are initially separated from each other. To assemble the canister 14, the o-ring 80 is stretched and fitted over the valve stem 22 to a position contacting the o-ring engaging portion 66 between the flanges 64, 68. The o-ring 82 is also stretched and fitted over the valve stem 22 onto the o-ring engaging portion 76 between the flanges 74, 78. The spring 84 is positioned on the valve stem 22 so that one end of the resilient member 84 contacts the flange 68 and is supported by the spring-retaining portion 70. The valve stem 22 with 0-rings 80, 82 and spring 84 are inserted through the recess 52 into the cavity 54. In this position, the flanges 64, 68 and o-ring 80 engage with a surface of the member 50 defining the cavity 54. The flanges 64, 68 are closely-fitting to the surface of the member 50 defining the cavity 54, preferably to a tolerance of 0.13 millimeters (i.e., 5/1000 of an inch) or less. The o-ring 80 makes a pressure-tight engagement with the surface of the member 50 defining the cavity 54. Because the cavity 54 is defined by the member 50 to be elongated along the canister's longitudinal axis 86, the valve stem 22 is constrained by contact with the member 50 to move only along such axis. Also, upon insertion of the valve stem 22 into the member 50, the spring 84 is positioned with one end contacting and retained by the flange 68, and another opposite end contacting and retained by the inner wall 58. As the valve stem 22 is positioned in FIG. 6*a*, the flanges 74, 78 and o-ring 82 are situated in contact with the inner wall 50 in the bore 60. The closeness of the fitting between the flanges 74, 78 and the inner wall 58 is preferably to a tolerance of 0.13 millimeters (i.e., 5/1000 of an inch) or less with the o-ring 82 in tight contact with the surfaces of the inner wall 58 defining the bore 60. The canister 14 also includes a washer 88 which is positioned over the valve stem 22 so that such washer encircles and contacts the washer-engaging portion 62 of the valve stem. The outer surfaces of the washer 88 are fixed by an adhesive, for example, to the portion of the member 50 defining the annular recess 52. The valve stem 22 is thus fixed to the canister 14 so that it is free to reciprocate in the washer 88 along the longitudinal axis 86. However, the washer 88 is positioned in FIG. 6*a* in contact with flange 64 so that the valve stem 22 is not forced out of the member 50 by pressure exerted by the contained repellent substance or by the bias applied to the valve stem 22 by the resilient member 84. The canister 14 also includes an end cap 90 that is fixed by adhesive such as model no. 980 commercially available from Loctite™, Inc. of Hartford, Conn., for example, to the end of the member 50 defining the reservoir 56 so that the reservoir is pressure-tight. The end cap 90 is substantially disk-like in shape and has a groove defined around the circumferential surface thereof. The end cap 90 should be closely fitting within the member 50 to a tolerance of about 0.13 millimeters (5/1000 of an inch) or less. The repellent substance 92 is filled into the reservoir so that the canister 14 initially contains the repellent substance under at least a few tens of pounds per square inch (PSI) to hundreds of PSI. Preferably, the repellent substance 92 is initially filled in the canister 14 under a pressure of at least about seventy PSI at room temperature. Because the repellent substance's pressure is proportional to the temperature the repellent experiences since the volume of the reservoir 54 is fixed, the canister 14 should be capable of withstanding repellent pressure up to about two-hundred PSI to which the canister may be subjected in relatively high-temperature environments or climates. The repellent substance 92 can be pepper spray (oleoresin capsicum derived from cayenne peppers), tear gas or mace, for example.

Figure 6B:
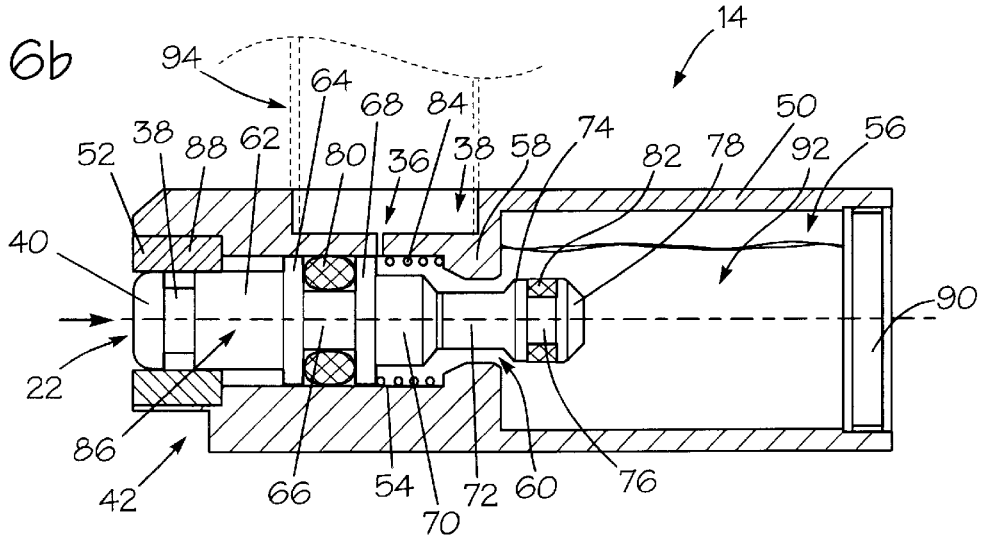
FIG. 6*b* is a partial cross-sectional view of the canister showing the valve stem in a second depressed position that permits discharge of the pressurized repellent contained in the canister.

In the position of FIG. 6*a*, the resilient member 84 biases the valve stem 22 to the left. In this position, the flanges 74, 78 and o-ring 82 are positioned in the bore 60 in contact with the inner wall 58 so that communication is blocked between the reservoir 56 and the cavity 54. In the position of FIG. 6*a*, the pressurized repellent substance 92 is sealed in the reservoir 56. In the position of FIG. 6*b*, the valve stem 22 is pushed into the canister 14 with a thumb or finger exerting force of greater than about thirty Newtons (i.e., seven pounds) on the relatively wide portion 40 to overcome the force of the resilient member 84. In this position of the valve stem 22, the flanges 74, 78 and o-ring 82 are pushed past the inner wall 58 which opens communication between the reservoir 56, the cavity 54, and the spray orifice 36. Because the repellent substance 92 is pressurized to be at a greater pressure than ambient pressure, the repellent substance 92 moves through the bore 60 between the surfaces of the inner wall 58 defining the bore 60 and the relatively thin passage portion 72 of the valve stem 22, into the cavity 54, around the resilient member 84, and out of the spray orifice 36 defined in member 50 in a dense, directional spray that can be used to disable an assailant. Release of thumb or finger pressure on the valve stem 22 permits the resilient member 84 to force the valve stem 22 outwardly from the canister 14 as shown in FIG. 6*a*, so that the flanges 74, 78 and o-ring 82 again contact the inner wall 58 to block communication between the cavity 54 and the reservoir 56. In this position of the valve stem 22, any repellent substance 92 remaining inside of the canister 14 is pressure-sealed inside of the canister's reservoir. The canister 14 initially contains sufficient pressurized repellent substance 92 to allow the user to operate the apparatus 10 so as to discharge a few to several bursts of repellent spray to provide more than one opportunity to disable an assailant.

The canister 14 is preferably about two-and-one-half centimeters or less along its longitudinal axis 86, with a diameter along a direction perpendicular to the longitudinal axis 86 that is one centimeter or less. As so configured, the apparatus 10 has a relatively compact form which disguises the fact that the canister 14 is contained in the ring 12. Hence an assailant will generally not recognize that the ring 12 has a canister 14 containing repellent substance 92 and will thus not be able to disarm the ring user. In addition, the canister 14 is also preferred to be adequately pressure-tight and to have sufficient volume in its reservoir 56 to contain enough of the pressurized repellent substance 92 to allow at least two or three disabling bursts of repellent spray to be discharged from the canister 14 to ensure more than one opportunity to disable an attacker. To provide more than one burst of spray, in general, the volume of the canister's reservoir 54 should be from 0.3 to 2.0 cubic centimeters filled with repellent substance 92 to a pressure of about seventy (70±25 PSI) at room temperature (i.e., about 20° Celsius).

To fill or refill the canister, a nozzle 94 communicatively coupled to a pressurized supply of the repellent substance 92, can be brought into contact with the flat surface 38 of the valve stem 22, as shown in broken line in FIG. 6*b*. The pressurized supply is preferably well above ambient pressure, preferably at least about seventy PSI. The valve stem 22 is pushed into the canister 14 so that pressurized repellent substance 92 flows from the nozzle 94 through spray orifice 36, around the resilient member 84, and into the cavity 54. In the cavity 54, the pressurized repellent substance 92 further travels between the passage portion 72 and the inner wall 58 through the bore 60 and into the reservoir 56. Upon filling the canister 14 with the repellent substance 92, the valve stem 22 is released so that the spring 84 forces the valve stem 22 to move to a position as shown in FIG. 6*a* in which the flanges 74, 78 and o-ring 82 again contact the inner wall 58 in the bore 60 to block communication between the cavity 54 and the reservoir 56. With the valve stem 22 so positioned, the pressurized repellent substance 92 is sealed in the reservoir 56 defined in the canister 14. The nozzle 94 can subsequently be moved out of contact with the canister 14, and the canister can be loaded into the cavity 19 of the ring 12 for use.

Figure 6C:
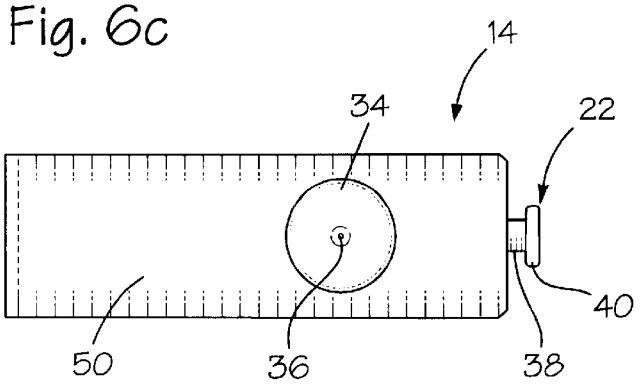
FIG. 6*c* is a top plan view of the canister showing an exterior flat surface around the spray orifice thereof.
Figure 6D:
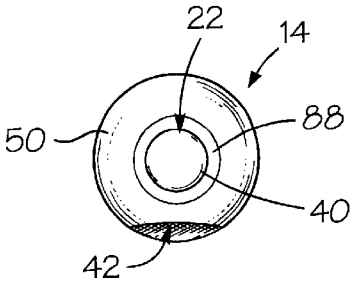
FIG. 6*d* is an end elevation view of the canister.

In FIG. 6*c*, the canister 14 is shown. The spray orifice 36 and the flat area 34 formed around the spray orifice 36 can be readily seen. In addition, the valve stem 22 with the relatively narrow portion 38 and the relatively wide portion 40 at the end of the valve stem 22, can be seen in FIG. 6*c*. FIG. 6*d* shows the canister 14 with its valve stem 22, or more particularly, the relatively wide portion 40 thereof, as well as the notch 42 defined in the canister. The upper surface of the member 50 that defines the notch 42 can be either flat or rounded as shown in FIG. 6*d*, to permit the wedge 44 to be swung more readily into and out of contact with the canister 14 in the notch 42.

The ring 12 can be made of a material such as metal or metal alloy or other materials commonly used in the jewelry industry. Such materials include sterling silver, pewter, gold, platinum or other metal. The ring 12 is generally made with a mold die into which molten metal or metal alloy is poured and permitted to cool to form the ring. The mold die is then opened to extract the ring. Alternatively, the ring 12 can be formed by machining a block of material into a predetermined ring configuration. It is also possible to form the ring 12 by a combination of molding and machining techniques. Jewels or other ornamental features 18 can be set into the ring 12 using techniques and materials well-known in the jewelry industry. The safety 16, wedge 44 and pin 48 can be composed of the same metal or metal alloy as the ring 12 molded and/or machined into their respective configurations. The pin 48 can be formed integrally with the ring 12. The ring 12 can be produced by numerous commercial sources, including Esposito Jewelry, Inc., Providence, R.I. The canister 14 can be made of a material such as brass, steel or other metals and metal alloys machined or molded in appropriate configurations. For example, the canister 14 can be machined from a block of alloy no. 360 free-machining brass. The valve stem 22 can be composed of steel or other metal or metal alloy. For example, the valve stem 22 can be part no. CS2292-2 composed of 303 stainless steel commercially-available from Clippard Instrument Laboratories, Cincinatti, Ohio. The resilient member 84 can be a coil or other spring composed of steel or other metal or metal alloy, or plastic. The resilient member 84 can be a spring such as part no. 11506 composed of 303, 304 or 316 stainless steel. The o-rings 80, 82 of the canister 14 are generally composed of buna nitrile rubber or other rubber or plastic material. Suitable o-rings are commercially available from numerous manufacturers and suppliers. For example, the o-rings 80, 82 can be part nos. 3809-98 and 3809-97, respectively, commercially-available from Precision Associates, Inc. of Minnesota. The washer 88 can be composed of brass or other metal or metal alloys machined or molded in an appropriate configuration. For example, the washer 88 can be a part no. 11505 composed of 360 free-machining brass manufactured by Clippard Instrument Laboratories, Inc. Cincinnati, Ohio. The end cap 90 can be composed of machined or molded brass, steel, plastic or metal or metal alloy. For example, the end cap 90 can be part no. CS2292-4 machined from 360 free-machining brass commercially-available from Clippard Instrument Laboratories, Cincinnati, Ohio.

In FIGS. 7*a*–7*c*, the sequence of steps for loading the apparatus 10 is shown. The canister 14 is pre-loaded with pressurized repellent spray. In FIG. 7*a*, the safety 16 is slid and the wedge 44 is pivoted to respective positions that clear the opening of the cavity 19. The canister 14 is inserted into the cavity 19, as shown in FIG. 7*a*. The canister 14 is positioned so that the wedge 44 can engage with the notch 42 defined in the canister 14 so that the canister spray orifice 36 is properly aligned with the ring's spray orifice 20. In FIG. 7*b*, the wedge 44 is pivoted about the pin 46 into the notch 42 to secure the canister 14 in the ring 12 and to ensure that the ring and canister spray orifices 20, 36 are aligned. In FIG. 7*c*, the safety 16 is moved by finger using the ridges 27 to provide a thumb or finger hold. The safety 16 is moved from its position disengaged from the valve stem 22 to a position in contact therewith. The tines 29 of the forked end 28 of the safety 16 engage with opposite sides of the relatively thin portion 38 of the valve stem 22. Because the tines 29 of the safety's forked end 28 block the relatively wide portion 40 of the valve stem 20, the valve stem cannot be moved so that accidental discharge of repellent spray from the apparatus 10 is prevented. After the safety is properly positioned, the user of the apparatus 10 can place the ring 12 on a finger, preferably on an index or middle finger.

Figure 8A:
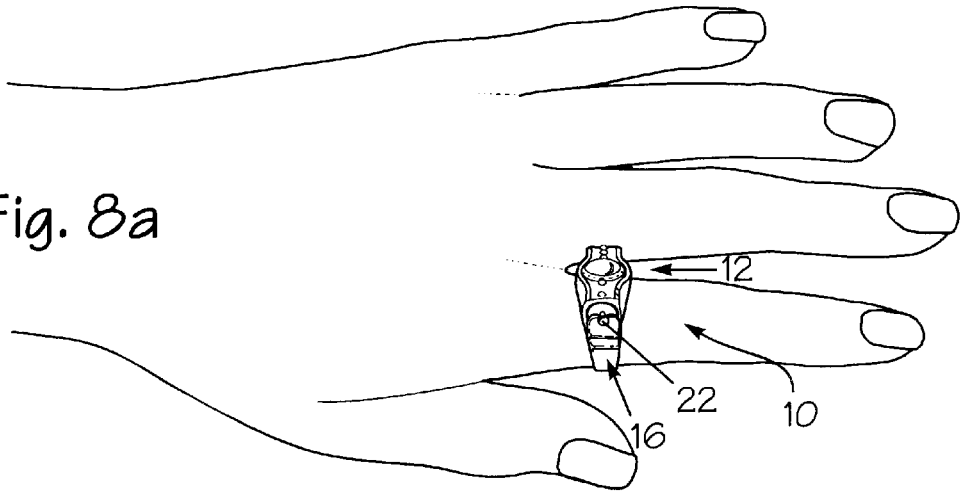
FIGS. 8*a*–8*c* are perspective views of a sequence of steps for discharging pressurized repellent from the self-defense ring apparatus.
Figure 8B:
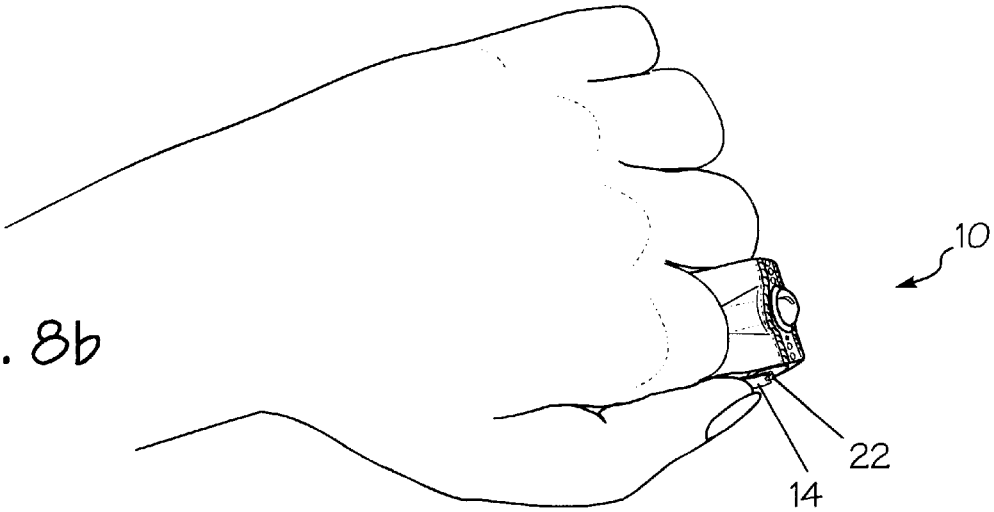
Figure 8C:
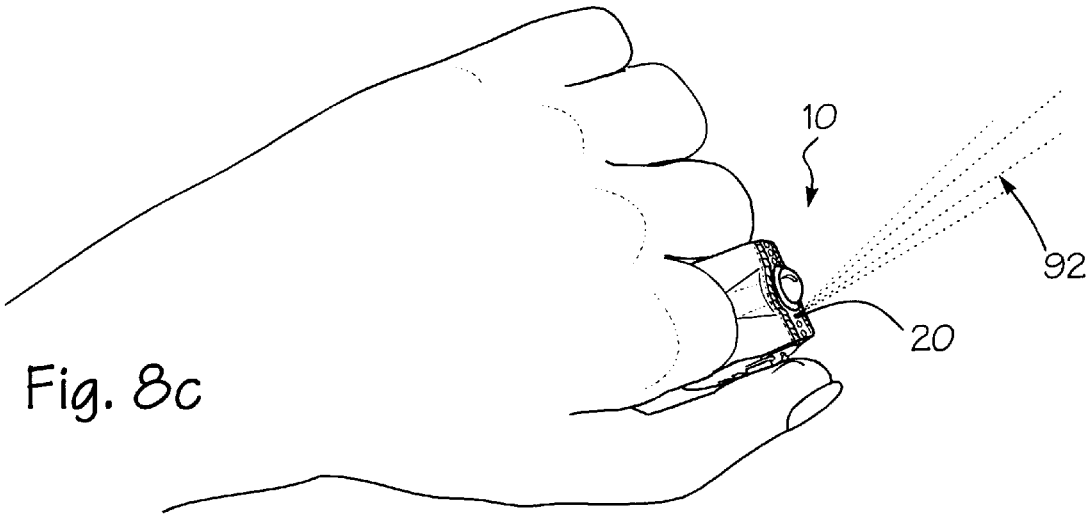

FIGS. 8*a*–8*c* show steps for discharging repellent spray from the apparatus 10. In FIG. 8*a*, the apparatus 10 is shown on the finger of a person with the safety 16 in a position engaged with the valve stem 22 to prevent accidental discharge of repellent spray from apparatus 10. In FIG. 8*b*, upon recognizing that an assailant (not shown) poses a threat of physical harm, the user moves a finger or the thumb of one hand to the safety 16 and slides the safety 16 to a position disengaged from the valve stem 22. In FIG. 8*c*, the user aims the ring orifice 20 of the apparatus 10, preferably at the eyes or nose of such assailant. The assailant's face should be between five (5) to fifty (50) centimeters from the ring 10 upon discharging the repellent spray to ensure that the assailant will be subjected to a sufficient dose of the repellent substance 92 to temporarily disable the assailant. In FIG. 8*c*, the user of the apparatus 10 depresses the valve stem 22 to discharge a spray burst of the repellent substance 92 at the assailant through the ring and canister spray orifices 20, 36. Although relatively small in size, the canister 14 can be loaded with a sufficient amount of repellent under a sufficiently high pressure to provide a few to several bursts of repellent spray before the canister is spent. The user of the apparatus 10 thus has more than one opportunity to disable an assailant and escape to safety.

Figure 9A:
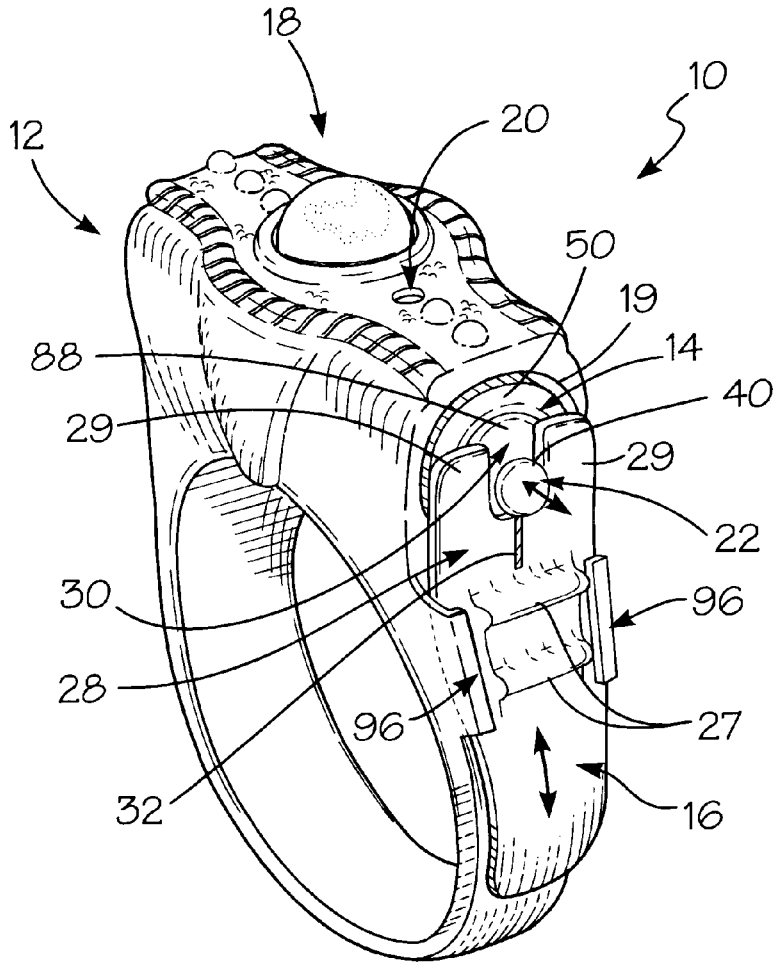
FIGS. 9*a* and 9*b* are views of an alternative configuration of the apparatus.
Figure 9B:
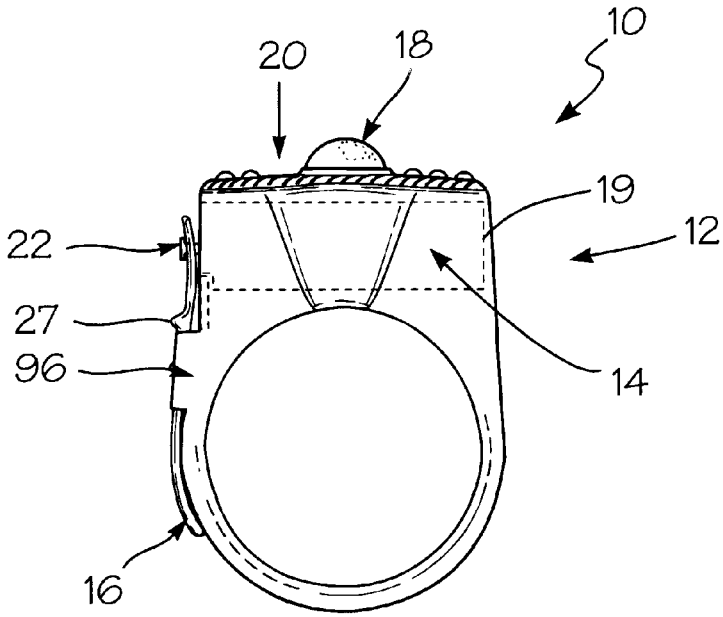

FIGS. 9*a* and 9*b* show an alternative configuration of the apparatus 10. The apparatus 10 of FIGS. 9*a* and 9*b* is similar in configuration and operation to the previously-described embodiment, except that the apparatus 10 of FIGS. 9*a* and 9*b* has no clasps 24 defined on the safety 16, but instead has clasps 96 that engage opposite sides of the safety 16 to secure the safety to the ring 12. The clasps 96 permit the safety 16 to be moved by sliding between positions blocking and unblocking the valve stem 22.

The many features and advantages of the present invention are apparent from the detailed specification and thus, it is intended by the appended claims to cover all such features and advantages of the described apparatus which follow in the true spirit and scope of the invention. Further, since numerous modifications and changes will readily occur to those of ordinary skill in the art, it is not desired to limit the invention to the exact construction and operation illustrated and described. Accordingly, all suitable modifications and equivalents may be resorted to as falling within the spirit and scope of the invention.

What is claimed is:

1. An apparatus comprising:

a ring defining a cavity and a spray orifice communicating with the cavity;

a repellent substance;

a canister removably fitted to the ring in the cavity, the canister containing the repellent substance under a pressure greater than ambient pressure, the canister defining a spray orifice, the canister having a valve stem movable to discharge the pressurized repellent substance through the spray orifices of the canister and ring; and a safety movably mounted to the ring, the safety having a first position that blocks the valve stem to prevent discharge of the pressurized repellent substance from the canister, and having a second position that unblocks the valve stem to permit the valve stem to be moved to discharge the repellent substance through the spray orifices of the canister and ring.

2. An apparatus as claimed in claim 1, wherein the safety defines ridges to permit a user to grip and move the safety between the first and second positions thereof.

3. An apparatus as claimed in claim 1, wherein the safety defines opposing clasps that engage with respective grooves defined in the ring to secure the safety to the ring so that the safety is slidable between the first and second positions thereof.

4. An apparatus as claimed in claim 1, wherein the ring defines opposing clasps that engage with the safety to hold the safety in contact with the ring so that the safety is slidable between the first and second positions thereof.

5. An apparatus as claimed in claim 1, wherein the safety includes a forked end having opposing tines spaced by a groove defined in the forked end between the tines, the tines engaging with opposite sides of a relatively thin portion of the valve stem if the safety is in its first position to block a relatively wide portion of the valve stem from moving in a direction permitting discharge of pressurized repellent from the canister.

6. An apparatus as claimed in claim 5, wherein the safety defines a slit at the base of the groove defined between tines of the forked end of the safety, to provide relatively enhanced flexibility for the tines so that the tines spread and grip the relatively narrow portion of the valve stem from opposing sides thereof if the safety is in its first position.

7. An apparatus as claimed in claim 1, wherein the ring defines a pin and the canister has an end defining a notch therein, the apparatus further comprising:

a wedge mounted to pivot about the pin, the wedge pivotable between a first position that opens the cavity so that the canister can be inserted or removed from the ring, and a second position in which the wedge is pivoted to engage with the notch defined in the canister if the canister is positioned in the ring cavity, the canister notch positioned relative to the canister's spray orifice and the wedge positioned relative to the ring's spray orifice so that the canister's spray orifice is substantially aligned to the ring's spray orifice if the wedge is positioned in its second position in the notch of the canister.

8. An apparatus as claimed in claim 1, wherein the canister includes a resilient member positioned in the interior of the canister to bias the valve stem toward a position thereof that prevents discharge of repellent substance from the canister.

9. An apparatus as claimed in claim 8, wherein the resilient member includes a spring.

10. An apparatus comprising:

a ring defining a cavity and a spray orifice communicating with the cavity;

a repellent substance;

a canister removably fitted to the ring in the cavity, the canister containing the repellent substance under a pressure greater than ambient pressure, the canister having a valve stem that is movable between a first position extended from the canister and blocking discharge of pressurized repellent from the canister, and a second position depressed into the canister relative to the first position and permitting discharge of the pressurized repellent through the spray orifices of the canister and ring, the valve stem having a relatively narrow portion and a relative wide portion at the end of the valve stem; and a safety slidably mounted to the ring, the safety having a forked end, the safety slidable to a first position in which the forked end of the safety engages with the narrow portion of the valve stem and blocks the relatively wide portion of the valve stem to prevent movement of the valve stem from its first position to its second position, the safety slidable to a second position in which the safety's forked end is disengaged from the relatively narrow portion of the valve stem to permit the valve stem to be depressed from the first position to the second position of the valve stem to discharge the pressurized repellent from the canister through the spray orifices of the canister and ring.

11. An apparatus as claimed in claim 10, wherein the safety defines ridges to permit a user to grip the safety to move the safety between the first and second positions thereof.

12. An apparatus as claimed in claim 10, wherein the safety defines opposing clasps that engage with respective grooves defined in the ring to secure the safety to the ring so that the safety is slidable between the first and second positions thereof.

13. An apparatus as claimed in claim 10, wherein the ring defines opposing clasps that engage with the safety to hold the safety in contact with the ring so that the safety is slidable between the first and second positions thereof.

14. An apparatus as claimed in claim 10, wherein the safety defines a slit at the base of the groove defined between tines of the forked end of the safety, to provide relatively enhanced flexibility for the tines so that the tines spread and grip the relatively narrow portion of the valve stem if the safety is in its first position.

15. An apparatus as claimed in claim 10, wherein the ring defines a pin and the canister has an end defining a notch therein, the apparatus further comprising:

a wedge mounted to pivot about the pin, the wedge pivotable between a first position that opens the cavity so that the canister can be inserted or removed from the ring and a second position in which the wedge is pivoted to engage with the notch defined in the canister positioned in the ring cavity, the canister notch configured relative to the canister's spray orifice and the wedge positioned relative to the ring's spray orifice so that the canister's spray orifice is substantially aligned to the ring's spray orifice if the wedge is positioned in its second position in the notch of the canister.

16. An apparatus as claimed in claim 10, wherein the canister includes a resilient member positioned in the interior of the canister to bias the valve stem toward the first position thereof.

17. An apparatus as claimed in claim 16, wherein the resilient member includes a spring.

* * * * *